US006106132A

United States Patent [19]

Chen

[11] Patent Number: 6,106,132

[45] Date of Patent: Aug. 22, 2000

[54] ILLUMINATING BALL PEN

[75] Inventor: Chen-Yi Chen, Hsi Chih, Taiwan

[73] Assignee: Taiwan Stamp Enterprise Co., Ltd., Hsi Chih, Taiwan

[21] Appl. No.: 09/437,689

[22] Filed: Nov. 10, 1999

[51] Int. Cl.[7] ..... B43K 29/10

[52] U.S. Cl. ..... 362/118; 362/253

[58] Field of Search ..... 362/109, 118, 362/208, 253, 276; 401/195

[56] References Cited

U.S. PATENT DOCUMENTS 5,143,465 9/1992 Hou ..... 362/118

5,735,592 4/1998 Shu ..... 362/118

*Primary Examiner*—Y. Quach

*Attorney, Agent, or Firm*—Dellett and Walters

[57] ABSTRACT

An illuminating ball pen includes an ink cartridge received in a barrel, a joint pipe threadly engaged on a top end of the barrel, a top seat which is easily connected/disconnected with an upper end of the joint pipe, a lighting assembly provided in the top seat and with a lighting element protruded into a transparent globe a the top of the top seat, and a stamping seat secured in a lower end of the top seat. The lighting element of the ball pen will light or flash when a user is writing or stamping with the ball pen, or shaking the ball pen up and down.

8 Claims, 4 Drawing Sheets

25
21
26
20
271
22
27
272
31
311
30
23
24
321
322
32
33
35
34
351
40
41
42
131
13
112
12
111
11
10

ILLUMINATING BALL PEN

BACKGROUND OF THE INVENTION

1. Field of the Invention

The present invention relates to an illuminating ball pen with a lighting assembly and a stamp seat provided therein to provide special attraction to potential purchasers.

2. Description of Related Art

Normally a ball pen is used to write or draw with only. However, the conventional ball pen is no longer good enough to stimulate potential purchasers in an increasingly fashionable and novel market. Various designs of new and interesting ball pens have appeared on the market and at present, a kind of stamp with a lighting assembly provided therein is popular with children. When a child is stamping paper, the light in the stamp is switched on to illuminate the paper. However, a ball pen with a lighting assembly and a stamp seat provided therein is still not seen up to present.

Therefore, it is an objective of the invention to provide an illuminating ball pen with a lighting assembly and a stamp seat provided therein to mitigate and/or obviate the aforementioned problems.

SUMMARY OF THE INVENTION

The object of the present invention is to provide an illuminating ball pen, which comprises an ink cartridge received in a barrel, a joint pipe threadly engaged on a top end of the barrel, and a top seat which is easily connected/disconnected with an upper end of the joint pipe, a lighting assembly provided in the top seat with a lighting element protruded into a transparent globe secured on a top of the top seat, and a stamping seat secured in a lower end of the top seat. After the top seat is detached from the joint pipe, the stamping seat can be used to stamp a piece of paper. When a user is writing or stamping with this ball pen, or shaking the ball pen up and down, the lighting element will interestingly light or flash.

Other objects, advantages and novel features of the invention will become more apparent from the following detailed description when taken in conjunction with the accompanying drawings.

DETAILED DESCRIPTION OF THE PREFERRED EMBODIMENT

Figure 1:
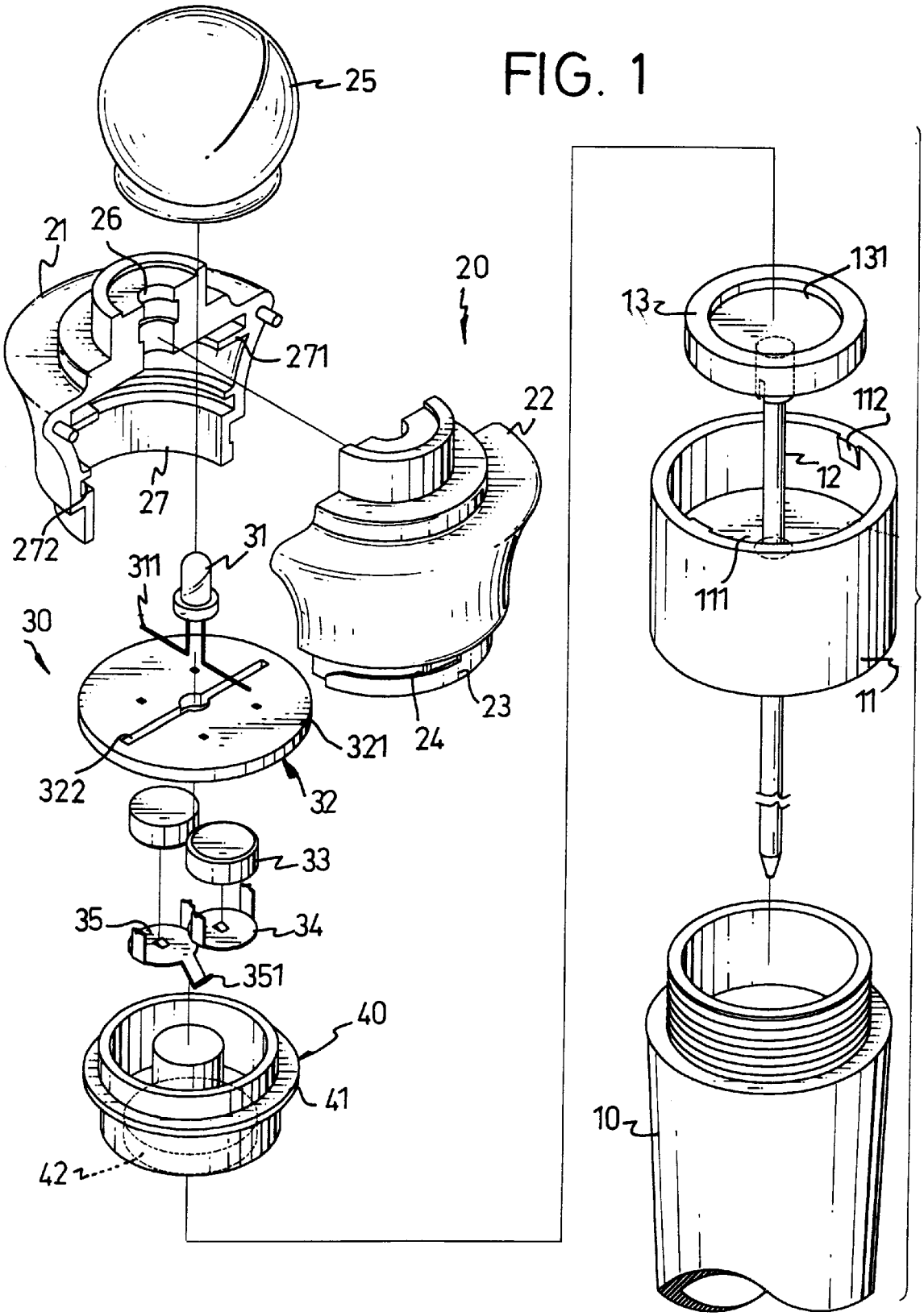
FIG. 1 is an exploded perspective view of an illuminating ball pen in accordance with the invention.
Figure 2:
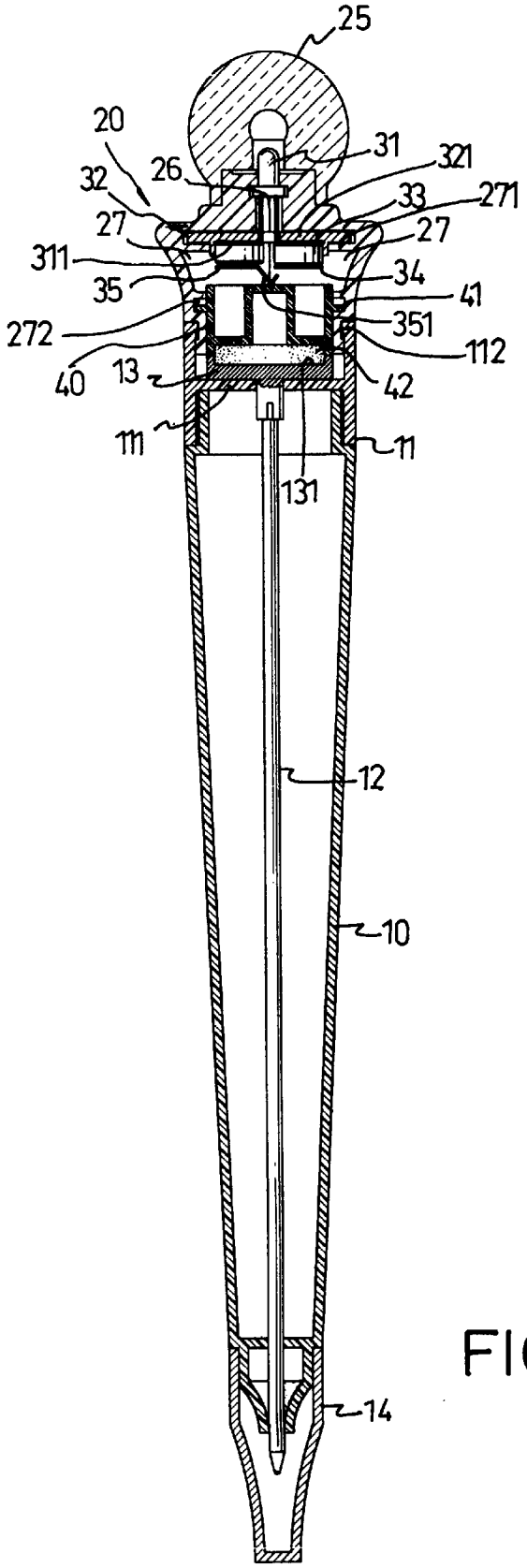
FIG. 2 is a cross sectional view of the illuminating ball pen in accordance with the invention.

As shown in FIGS. 1 and 2, the present invention relates to an illuminating ball pen, which comprises a barrel (10), ajoint pipe (11) threadly engaged on an upper end of the barrel (10), an ink cartridge (12) received in the barrel (10), a protective cap (14) covering a lower end of the barrel (10) to protect a point end of the ink cartridge (12), and a top seat (20) which is easily connected/disconnected on an upper end of the joint pipe (11) with a lighting assembly (30) and a stamp seat (40) provided therein.

The joint pipe (11) integrally forms a radial partition (111) in the middle thereof. The point end of the ink cartridge (12) is extended through the partition (111). A retaining cap (13) is fixed to the ink cartridge (12) at an end opposite the point end, and is stopped by the partition (111). The retaining cap (13) defines a recess (131) in a top surface thereof.

The top seat (20) includes a right portion (21) and a left portion (22) detachably combined together by means of sockets and dowels. A lower end (23) of the top seat (20) can be easily connected/disconnected with the upper end of the joint pipe (11) via a slide slot (24) defined therein and a corresponding slide block (112) integrally formed on an inner surface of the joint pipe (11). A transparent globe (25) is secured on a top of the top seat (20). The top seat (20) further defines a positioning hole (26) and an inner space (27) to receive the lighting assembly (30) and the stamp seat (40) therein.

The lighting assembly (30) includes a lighting element (31) which is fitted in the positioning hole (26) and protrudes into the transparent globe (25), a cell seat (32) which has a circular plate (321) fitted in a first annular groove (271) that is defined in an inner periphery defining the inner space (27), and two electric cells (33) fixed on a bottom side of the plate (321) by a first and a second metal clip (34, 35).

The stamp seat (40) integrally forms a flange (41) therearound to be fitted in a second annular groove (272) that is defined in the inner periphery of the top seat (20) and near the lower end thereof. The second annular groove (272) is designed to allow the stamping flange (41) to be longitudinally movable therein. A stamping face (42) is secured in a bottom of the stamp seat (40) with a protruding part thereof received in the recess (131) of the retaining cap (13).

The lighting element (31) is preferably an LED element. Two L-shaped contact pins (311) can be turned about 90° after the lower ends thereof are extended through a narrow slot (322) defined in the plate (321) and respectively contact with an anode of a first of the cells (33) and a cathode of the second cell (33). The first metal clip (34) is normally isolated from the second metal clip (35). When an extended portion (351) of the second metal clip (35) is pressed up to contact the first metal clip (34), the lighting element (31) is switched on for illumination.

Figure 4:
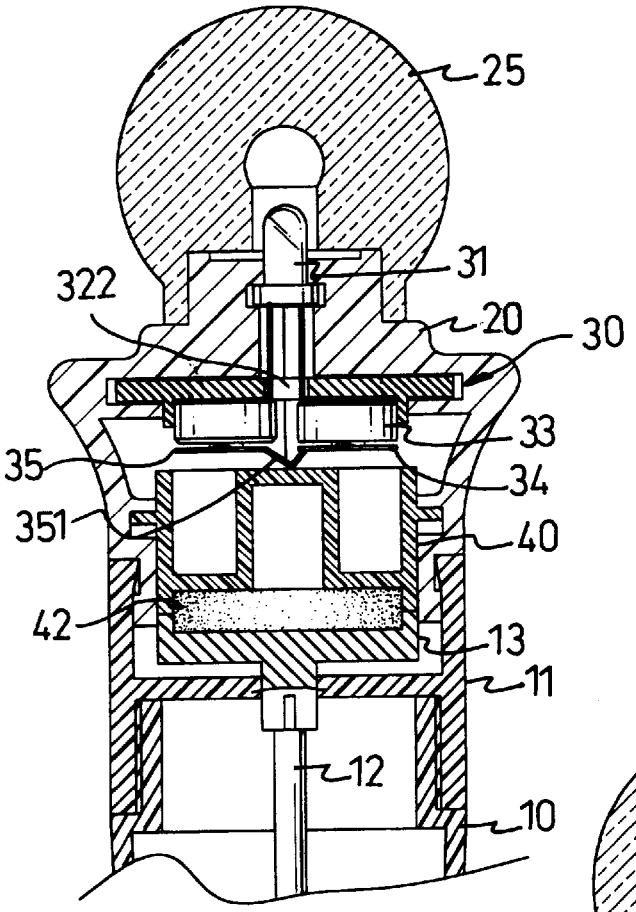
FIG. 4 is a partial cross sectional view of the illuminating ball pen in accordance with the invention, showing the ball pen in a writing mode.
Figure 3:
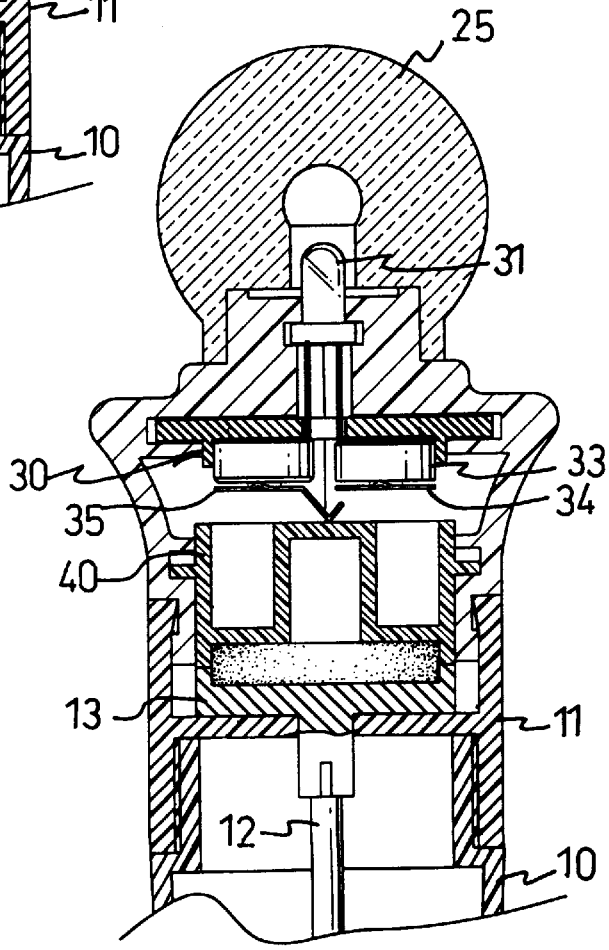
FIG. 3 is a partial cross sectional view of the illuminating ball pen in accordance with the invention, showing the ball pen before being shifted to a writing mode.

As shown in FIG. 3, before a user writes with the ball pen, the extended portion (351) of the second metal clip (35) is isolated from the first metal clip (34). When a user is writing with the ball pen, as seen in FIG. 4, the ink cartridge (12) is pushed in to press the extended portion (351) upwardly, so that the second metal clip (35) contacts the first metal clip (34) to switch on the lighting assembly (30). Therefore, the lighting element (31) lights or flashes on during the writing process.

Figure 5:
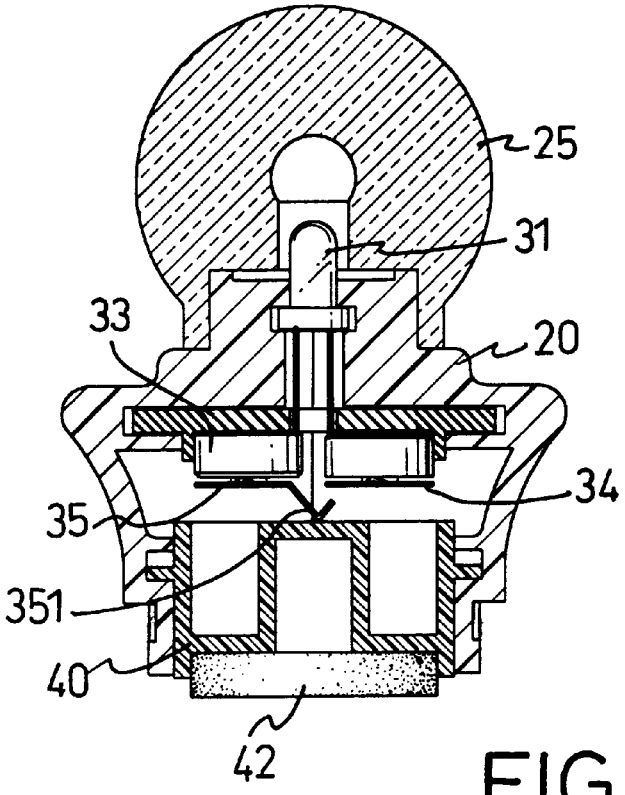
FIG. 5 is a partial cross sectional view of the illuminating ball pen in accordance with the invention, showing the ball pen before being shifted to a stamping mode.
Figure 6:
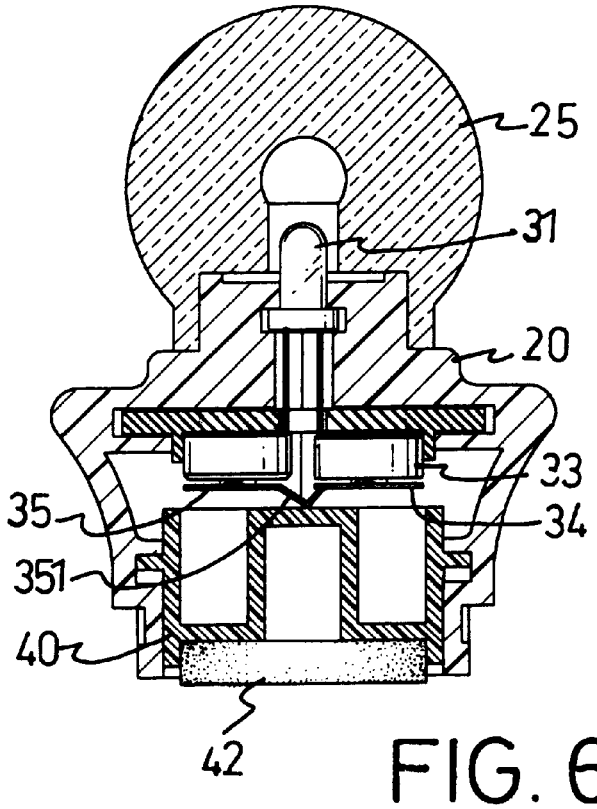
FIG. 6 is a partial cross sectional view of the illuminating ball pen in accordance with the invention, showing the ball pen used in the stamping mode.

As shown in FIG. 5, the top seat (20) is disconnected from the joint pipe (11) of the ball pen. Before stamping, the extended portion (351) of the second metal clip (35) is isolated from the first metal clip (34). When a user places the stamping face (42) on a surface and presses down the top seat (20) of the ball pen to begin stamping, as seen in FIG. 6, a top of the stamp seat (40) presses the extended portion (351) to make the second metal clip (35) contact with the first metal clip (34). Therefore, the lighting assembly (30) is switched on to illuminate by using the stamping function of the ball pen.

When the user shakes the barrel (10) of the ball pen up and down, the stamp seat (40) moves up and down to switch on and off the lighting assembly (30), so that the lighting element (31) flashes.

The illuminating ball pen in accordance with the present invention has at least the following advantages:

1. the structure of the ball pen of the present invention is simple and compact;
2. the electric connection of the lighting assembly (30) is reliable; and
3. the ball pen provided with the lighting assembly (30) and stamp seat (40) is very interesting and will appeal to young people and children.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An illuminating ball pen comprising a barrel (10), a joint pipe (11) threadedly engaged on an upper end of the barrel (10), an ink cartridge (12) received in the barrel (10), a protective cap (14) covering a lower end of the barrel (10) and a top seat (20) easily connected and disconnected on an upper end of the joint pipe (11); wherein the top seat (20) includes a right portion (21) and a left portion (22) detachably combined together with a transparent globe (25) secured on a top thereof, and a positioning hole (26) and an inner space (27) defined in the top seat (20); lighting assembly (30) is provided in the inner space (27) with a lighting element (31) fitted in the positioning hole and protruded into the globe (25);

a cell seat (32) is received in the inner space (27) with two electric cells (33) fixed therein by two normally isolated metal clips (34, 35), wherein an extended portion (351) of a second of the metal clips (35) is elastic and movable to contact the first metal clip (34) by an upward force; and a stamp seat (40) is movably fitted in a lower end of the top seat (20).

2. The illuminating ball pen as claimed in claim 1, wherein the joint pipe (11) integrally forms a radial partition (111) in a middle of the joint pipe (11), the ink cartridge (12) extends through the partition (111) with a retaining cap (13) securely fixed on the ink cartridge (12) and stopped by the partition (111).

3. The illuminating ball pen as claimed in claim 2, wherein the retaining cap (13) defines a recess (131) in a top surface thereof.

4. The illuminating ball pen as claimed in claim 1, wherein the left portion (21) and the right portion (22) are combined together by sockets and dowels.

5. The illuminating ball pen as claimed in claim 1, wherein the top seat (20) is easily connected and disconnected on the upper end of the joint pipe (11) by a slide slot (24) defined in the lower end of the top seat (20) and a slide block (112) correspondingly formed on an inner surface of the joint pipe (11).

6. The illuminating ball pen as claimed in claim 1, wherein the top seat (20) defines a first annular groove (271) to receive a circular plate (321) of the cell seat (32) therein.

7. The illuminating ball pen as claimed in claim 6, wherein the lighting element (31) is an LED element with two L shaped contact pins (311), which lower ends thereof extend through a slot (322) defined in the circular plate (32) and respectively contact with an anode of one cell (33) and a cathode of the other cell (33).

8. The illuminating ball pen as claimed in claim 1, wherein a second annular groove (272) is defined in the inner space (27) near the lower end of the top seat (20) to receive a flange (41) integrally formed around the stamp seat (40) in the inner space (27), and the second annular groove (272) is spaced to allow the stamp seat (40) to be movable therein, whereby the extended portion (351) of the second metal clip (35) is able to be pushed up to contact with the first metal clip (34).

* * * * *